US007053834B2

(12) United States Patent
Ueda

(10) Patent No.: US 7,053,834 B2
(45) Date of Patent: May 30, 2006

(54) ANTENNA

(75) Inventor: Osamu Ueda, Tokyo (JP)

(73) Assignee: Clarion Co., Ltd., Tokyo (JP)

( * ) Notice: Subject to any disclaimer, the term of this patent is extended or adjusted under 35 U.S.C. 154(b) by 0 days.

(21) Appl. No.: 10/812,932

(22) Filed: Mar. 31, 2004

(65) Prior Publication Data

US 2005/0134508 A1 Jun. 23, 2005

(30) Foreign Application Priority Data

Mar. 31, 2003 (JP) ..... P2003-093761

(51) Int. Cl.
*H01Q 1/38* (2006.01)

(52) U.S. Cl. ..... 343/700 MS; 343/846

(58) Field of Classification Search ..... 343/700 MS, 343/702, 846, 848
See application file for complete search history.

(56) References Cited

U.S. PATENT DOCUMENTS 6,014,114 A * 1/2000 Westfall et al. ..... 343/846
6,433,742 B1 * 8/2002 Crawford ..... 343/700 MS
2004/0217907 A1 * 11/2004 Inoue ..... 343/728

FOREIGN PATENT DOCUMENTS

JP 7-30316 1/1995
WO WO 03-026069 3/2003

OTHER PUBLICATIONS

European Search Report dated Jul. 16, 2004.
Kashani et al., "Analysis of a ridged circular disc microstrip antenna element using the cavity model", IEEE Proceedings H. Microwaves, Antennas & Propagation, Institution of Electrical Engineers. Stevenage, GB, vol. 148, No. 3, Jun. 11, 2001, pp. 213-217, XP006016885.

* cited by examiner

*Primary Examiner*—Hoang V. Nguyen
(74) *Attorney, Agent, or Firm*—McGinn IP Law Group,PLLC

(57) ABSTRACT

A multi-band flat antenna that shows excellent radio characteristics in each of multiple different frequency bands. In a patch antenna, a plurality of flat antenna patterns for different frequency bands are formed on a dielectric substrate. The dielectric substrate has different plate thicknesses in each of the regions where the flat antenna patterns are formed.

16 Claims, 3 Drawing Sheets

ANTENNA

BACKGROUND OF THE INVENTION

1. Field of the Invention

This invention relates to a flat antenna, and particularly to a so-called multi-band antenna effective in a plurality of different frequency bands.

2. Description of the Related Art

Antennas in related art include multi-band antennas that handle a UHF signal and an LF signal. (For example refer to JP-A-7-30316, Page 3, 4 and FIG. 2)

As shown in FIG. 2 of JP-A-7-30316, an inner circular antenna element 7 and an outer annular antenna element 8 disposed on the same region as the inner circular antenna element surrounding the inner circular antenna element, and are provided on a circular plate 6 made of a dielectric material. Both of the antenna elements 7 and 8 are used for transmitting UHF signals, and the outer annular antenna element 8 is used for receiving LF signals. Accordingly, the transmission of UHF signals and reception of LF signals, which are in mutually different frequency bands, are possible.

Now, in a case where this kind of idea for multi-band idea is applied to a patch antenna shown in FIGS. 5A and 5B of the drawings accompanying the present specification and a plurality of antenna patterns having different frequency bands are formed on the same plane region on a dielectric substrate in the form of a flat plate having a uniform thickness, it is not possible to obtain a good multi-band antenna showing characteristics corresponding to the required frequency bands.

That is, in flat antennas like the patch antennas shown in FIG. 5A and FIG. 5B, in a case where the desired frequencies to which the antenna is applied are high, lengths A, A' of the antenna patterns 2A, 2B become correspondingly shorter. Consequently, for example in a case where on a flat plate dielectric substrate 3 having a uniform thickness B suited to the antenna pattern 2A for a low frequency, the antenna pattern 2B for a higher frequency is formed, the length A' of the high frequency antenna pattern may be smaller than the plate thickness B of the dielectric substrate.

In a case where the thickness B of the dielectric substrate 1 is sufficiently smaller than the length A of the antenna pattern 2A as shown in FIG. 5A, because an electric field E in the plate thickness direction created by received electric waves acts effectively upon the antenna pattern 2A, the electric waves can be efficiently received by the antenna pattern 2A. However, in a case where the thickness B' of the dielectric substrate 3 is greater than the length A' of the antenna pattern 2B as shown in FIG. 5B, the electric field E readily deviates from the plate thickness direction, i.e. the direction toward the antenna pattern 2A, radiation losses arise, and efficient reception becomes difficult.

Accordingly, a multi-band flat antenna, which shows excellent radio characteristics in each of multiple different frequency bands, has been awaited.

SUMMARY OF THE INVENTION

It is therefore an object of the present invention to provide a multi-band flat antenna, which shows excellent radio characteristics in each of multiple different frequency bands.

To achieve the object and other objects, the present invention provides an antenna having a plurality of flat antenna patterns that receives or transmits electric waves having different frequency bands respectively formed on a dielectric substrate, including that a plate thickness of the dielectric substrate in each region where the flat antenna pattern is formed is different.

In the antenna according to the invention, for example by changing partially a thickness of the dielectric substrate having a flat back side, it is possible to form flat regions at different height levels on its front side, and it is possible to form the antenna patterns having lengths suited to respective frequency bands of the electric waves that each of the antenna patterns receives or transmits on these flat regions. And by setting the thicknesses of the respective flat regions of the dielectric substrate to thicknesses suited to the frequency bands of the electric waves that each of the antenna patterns provided on those flat regions receives or transmits, a flat antenna, which shows good radio characteristics with low radiation losses in those respective frequency bands, is formed.

Accordingly, with the invention, it is possible to form a flat antenna, which shows excellent radio characteristics in each of multiple different frequency bands.

A back side of the dielectric substrate can be configured to be flat, and a front side can be configured to be step. In the case, a grounding conductor is formed on the flat back side and flat antenna patterns are formed on each of regions of the dielectric substrate configured to be step respectively.

A dielectric substrate having the regions like this can be easily made with a synthetic resin material.

A plurality of multiple regions can be made up of a central region defined by a single closed line and a plurality of annular regions surrounding the central region and each defined by two mutually concentric closed lines. The central region and the annular regions are disposed at sequentially different height positions.

The flat antenna patterns are sequentially disposed on the regions in order of the frequency bands of the electric waves that each of the flat antenna patterns receives or transmits. And the thickness of each of the regions of the dielectric substrate are configured to be increased sequentially from the central region to the annular region that is positioned outermost.

Reversely to this, the thickness of each of the regions of the dielectric substrate are configured to be decreased sequentially from the central region to the annular region that is positioned outermost.

The frequency bands of the electric waves that each of the flat antenna patterns receives or transmits are configured to be increased sequentially from the frequency bands of the electric waves that the flat antenna pattern disposed on the central region receives or transmits, to the frequency bands of the electric wave that the flat antenna pattern disposed on the annular region that is positioned outermost receives or transmits.

BRIEF DESCRIPTION OF THE DRAWING

These and other objects and advantages of the invention will become more fully apparent from the following detailed description taken with the accompanying drawings in which.

DETAILED DESCRIPTION OF THE PREFERRED EMBODIMENTS

The invention will now be described in detail with reference to a number of presently embodiments thereof.

Figure 1:
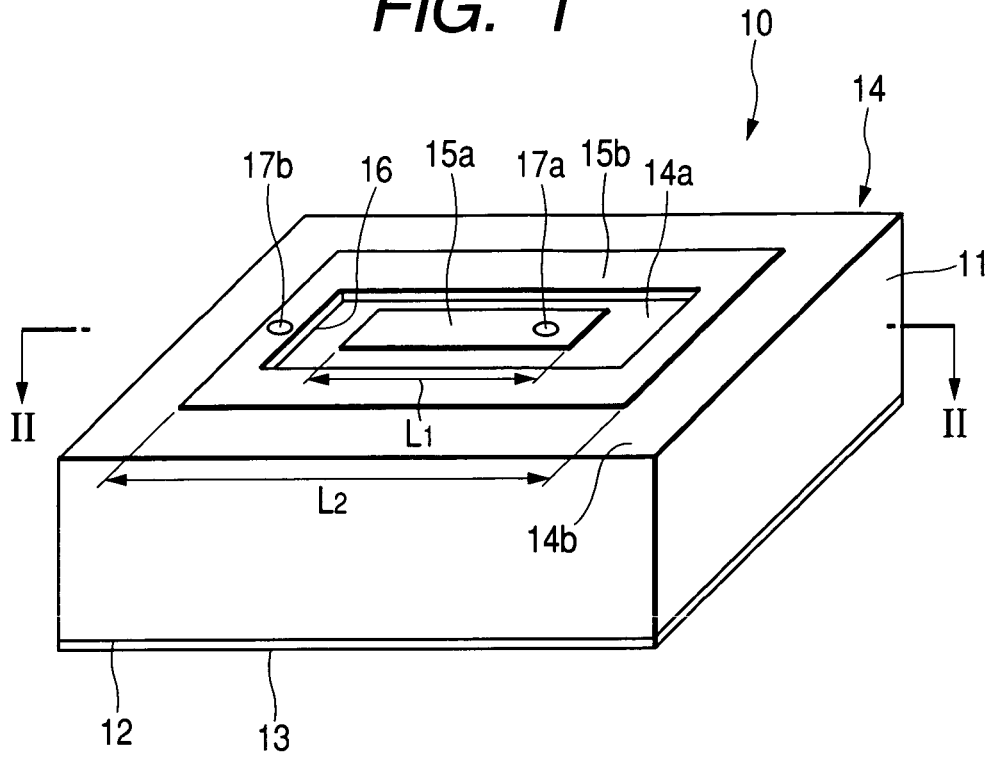
FIG. 1 is a perspective view showing a first embodiment of an antenna according to the invention.
Figure 2:
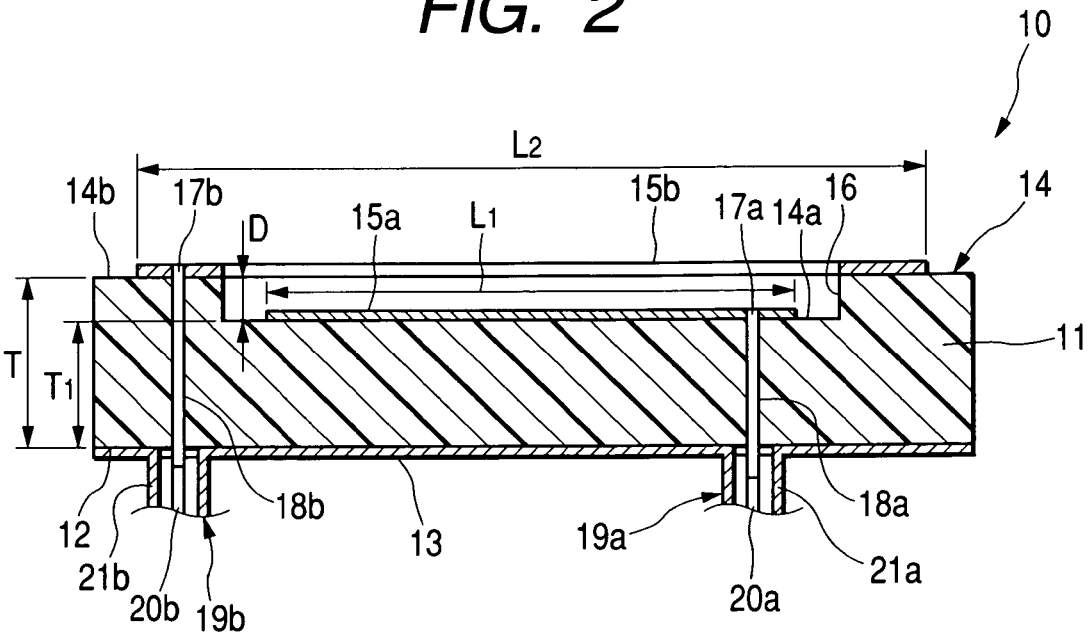
FIG. 2 is a sectional view on a line II—II in FIG. 1.

FIGS. 1 and 2 show a first preferred embodiment of the invention. As shown in FIG. 1, a patch antenna 10 according to the invention has a dielectric substrate 11, a grounding conductor 13 formed on a back side 12 of the dielectric substrate 11, and two antenna patterns 15 (15*a* and 15*b*) formed on a front side 14 of the dielectric substrate 11.

As shown in FIG. 2, the dielectric substrate 11 is made of a synthetic resin material in the shape of a plate having a substantially uniform plate thickness T, and the back side 12 is configured to be flat and is covered with the grounding conductor 13.

A rectangular recess 16 having a uniform depth D is entirely formed in the front side 14 of the dielectric substrate 11. A bottom region 14*a* of the recess 16 is parallel with the back side 12 of the dielectric substrate 11. The bottom region 14*a* of the recess 16 is a rectangular bottom region defined by a single rectangular straight closed line, and the recess 16 divides the front side 14 of the dielectric substrate 11 into the rectangular central flat region 14*a* constituted by the bottom region of the recess 16 and an annular rectangular flat region 14*b* surrounding the recess 16.

Accordingly, the plate thickness T1 of the dielectric substrate 11 at the central region 14*a* constituting the central flat region is smaller by the depth D of the recess 16 than the plate thickness T at the annular region 14*b* constituting the rectangular flat region, and as a result of being at different height levels from the back side 12 the central region 14*a* and the annular region 14*b* form regions 14*a*, 14*b* in the front side 14.

A first rectangular flat antenna pattern 15*a* having a length L1 is formed on the central region 14*a* along the length direction of the central region, and a second flat antenna pattern 15*b* consisted of a rectangular frame having a length L2 is formed on the annular region 14*b* along the perimeter of the recess 16. So that they each resonate at a desired frequency as well known conventionally, the lengths L1, L2 of the antenna patterns 15 (15*a* and 15*b*) are set to for example half value the wavelengths of their respective frequencies. These antenna patterns 15 (15*a* and 15*b*) can be formed for example by forming a conductive layer for the antenna patterns so that the conducting layer covers the regions 14*a*, 14*b* and then removing unwanted parts of it by etching as well known conventionally.

As shown in FIG. 2, supply pins 18*a*, 18*b* electrically insulated from the grounding conductor 13 are connected to the antenna patterns 15 (15*a* and 15*b*) at respective supply points 17*a*, 17*b* thereof. Core wires 20*a*, 20*b* of coaxial cables 19*a*, 19*b* are connected to the supply pins 18*a*, 18*b*, and shield wires 21*a*, 21*b* of the coaxial cables 19*a*, 19*b* are connected to the grounding conductor 13.

In the patch antenna 10 of the invention, the thicknesses T, T1 at the flat regions 14*a*, 14*b* of the dielectric substrate 11 on which the antenna patterns 15 (15*a* and 15*b*) are provided are set to suitable thicknesses in accordance with the frequency bands corresponding to their antenna lengths L1, L2 so as to minimize radiation losses.

That is, the antenna length L1 of the first antenna pattern 15*a* is smaller than the antenna length L2 of the second antenna pattern 15*b*, and a resonant frequency band of the first flat antenna pattern 15*a* is higher than that of the second antenna pattern 15*b*. In correspondence with the difference between these antenna lengths L1 and L2, to reduce radiation losses, the plate thickness T1 of the dielectric substrate 11 at the central flat region 14*a* on which the first antenna pattern 15*a* having the smaller antenna length L1 is formed is set smaller than the plate thickness T of the dielectric substrate 11 at the annular flat region 14*b* on which the second flat antenna pattern 15*b* having the longer antenna length L2 is formed. And, the widths of the antenna patterns 15 (15*a* and 15*b*) in the direction perpendicular to their antenna lengths L1, L2 are appropriately selected to suit the radiation of electric waves.

Thus, in the patch antenna 10 of the invention, because as described above a plate thickness of the dielectric substrate 11 is set suitably for each of flat regions 14*a*, 14*b* so as to reduce radiation losses in correspondence with flat antenna patterns 15*a* and 15*b* having antenna lengths L1 and L2 in accordance with corresponding respective frequency bands, it is possible to obtain good radio characteristics with low radiation losses in the transmission and reception of electric waves of two wavelength bands.

It is also possible to change the plate thickness of the dielectric substrate 11 in each of the regions on which the antenna patterns 15*a* and 15*b* are formed by forming a recess 16 of the kind described above in the back side 12 of the dielectric substrate 11 on which the grounding conductor 13 is provided flat, in order to make the back side 12 stepwise, and to make the front side 14 on which the antenna patterns 15 (15*a* and 15*b*) are provided, flat.

However, in the case, because it is necessary for substantially all of the stepwise back side 12 to be covered with the grounding conductor 13, a process of forming the grounding conductor 13 becomes more complicated. On the other hand, by making the front side 14 on which the antenna patterns 15 (15*a* and 15*b*) are provided stepwise and forming the grounding conductor 13 uniformly on a flat back side 12 as described above, it is possible to form the antenna patterns 15*a* and 15*b* on the respective regions 14*a*, 14*b* and the antenna can be manufactured more easily.

Although the dielectric substrate 11 can be made of a ceramic dielectric material, from the point of view of procuring a stepwise dielectric substrate 11 having the required shape easily, it is preferable for the dielectric substrate 11 to be made from a synthetic resin material as described above.

This kind of 2-band patch antenna 10 can be used for example in an AMPS or PCS 2-band mobile telephone.

Figure 3:
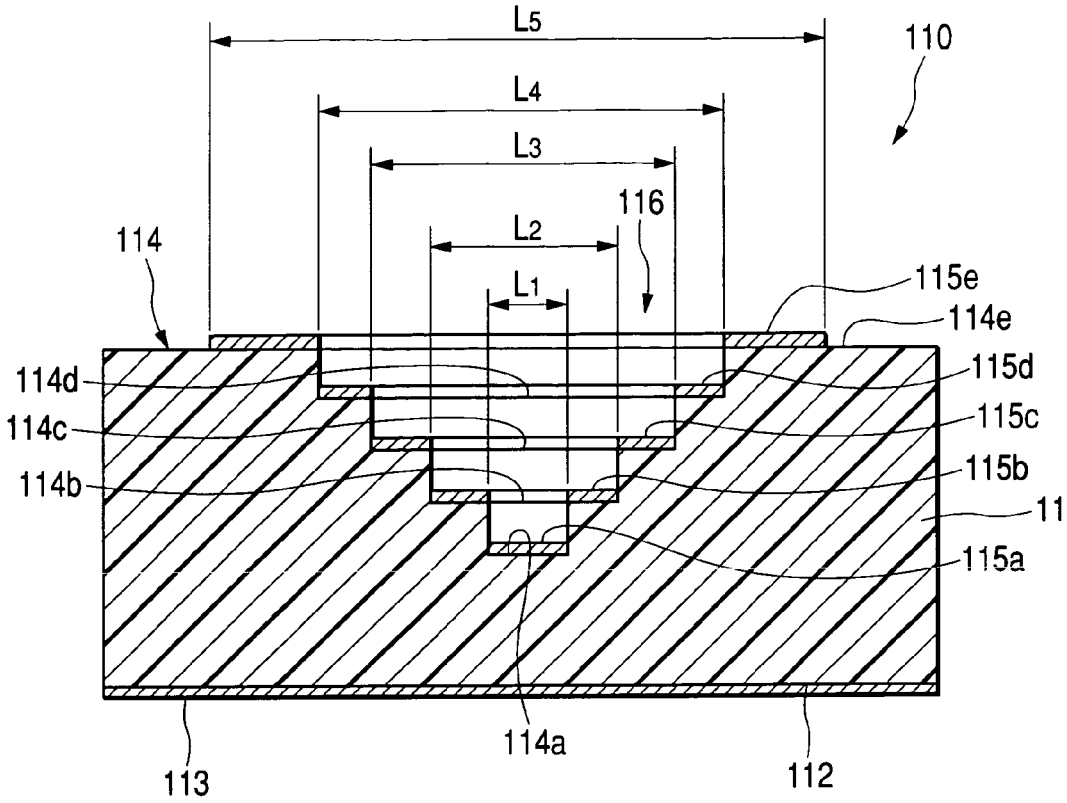
FIG. 3 is a sectional view illustrating a second embodiment of an antenna according to the invention.

FIG. 3 shows a second embodiment. The antenna 110 shown in FIG. 3 is an example of a multi-band antenna that can be applied to five different frequency bands.

A rectangular recess 116 is formed on the front side 114 of a dielectric substrate 11 of the antenna 110, and a rectangular central region 114*a* defined by a single rectangular straight line is formed on a central bottom region of the recess 116. A wall of the recess 116 is stepwise, so that the width of the recess 116 gradually increases toward an opening of the recess. As a result of the gradual increasing of the width of the recess 116, first, second, third and fourth annular regions 114*b*, 114*c*, 114*d* and 114*e* are formed sequentially, surrounding the central region 114*a*. The annular regions 114*b*, 114*c*, 114*d* and 114*e* are each defined at their inner and outer peripheries by two similar concentric rectangles, and they are successively at greater height positions from a back side 112. The central region 114*a* and the annular regions 114*b*, 114*c*, 114*d* and 114*e* constitute regions

114*a* through 114*e*, and the plate thickness of the dielectric substrate 11 at the regions 114*a* through 114*e* gradually increases sequentially from the central region 114*a* toward the annular region 114*e* positioned at the opening of the recess 116.

With the regions 114*a* through 114*e* formed by the central region 114*a* and the annular regions 114*b*, 114*c*, 114*d* and 114*e* surrounding the central region 114*a* as flat regions, first through fifth flat antenna patterns 115*a* through 115*e* are formed on these flat regions 114*a* through 114*e*.

A rectangular first antenna pattern 115*a* similar to that shown in FIG. 1 is formed on the central region 114*a*, and rectangular framelike second through fifth antenna patterns 115*b* through 115*e* similar to that shown in FIG. 1 are disposed on the annular regions 114*a* through 114*e*. The first through fifth antenna patterns 115*a* through 115*e* gradually increase lengths L1 through L5 sequentially. In FIG. 3, each supply points and supply pins have been omitted to simplify the drawing.

With the antenna 110 shown in FIG. 3, in correspondence with the decreasing of the antenna lengths L1 through L5 corresponding to the frequency bands of the antenna patterns 115*a* through 15*e*, the plate thicknesses of the step parts constituting the regions on which the antenna patterns 115*b* through 115*e* are disposed are gradually decreased toward the central part of the dielectric substrate 11, whereby a plate thickness of the dielectric substrate 11 is suitably set for each of the regions 114*a* to 114*e* on which the antenna patterns 115*b* to 115*e* are disposed. As a result, radiation losses in the respective frequency bands are suppressed and respective electric waves of the same number of frequency bands as the antenna patterns 115*b* through 115*e* can be transmitted and received well.

As necessary, the first antenna pattern 115*a* can be made circular instead of rectangular and the second through fifth antenna patterns 115*b* to 115*e* can be made circular rings instead of rectangular rings.

Although in the first and second embodiments, examples were described wherein recesses 16, 116 are formed in a dielectric substrate 11 to make regions being stepwise, alternatively it is possible to form multiple convex parts 216 in the front side 214 of the dielectric substrate 11 and form first through fifth flat antenna patterns 215*a* to 215*e* on regions 214*a* to 214*e*. A grounding conductor 213 similar to that mentioned above is then formed on the back side 212 of the dielectric substrate 11.

Figure 4:
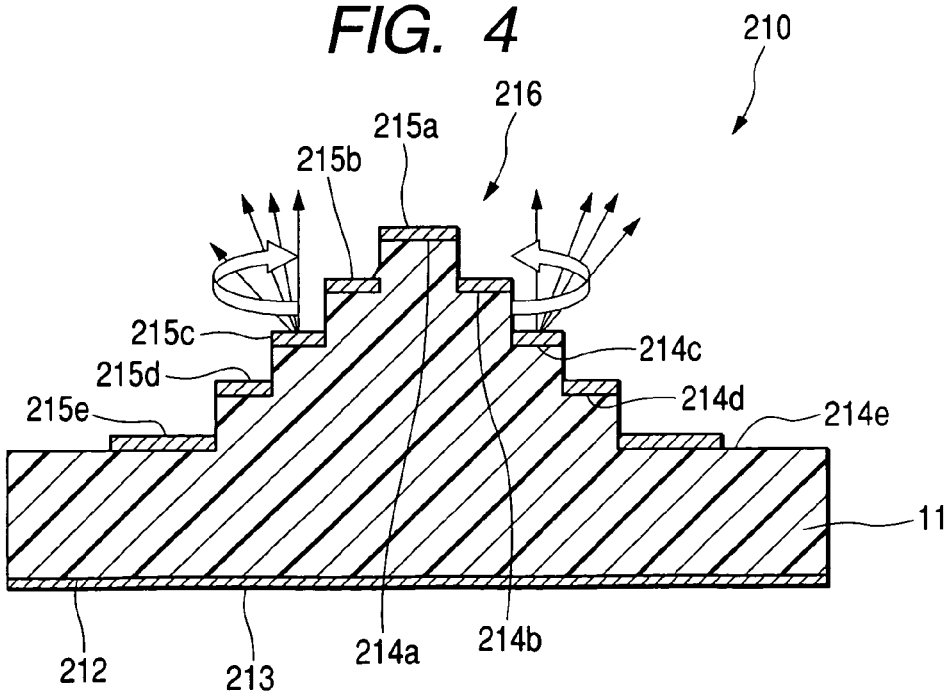
FIG. 4 is a sectional view illustrating a third embodiment of an antenna according to the invention.
Figure 5A:
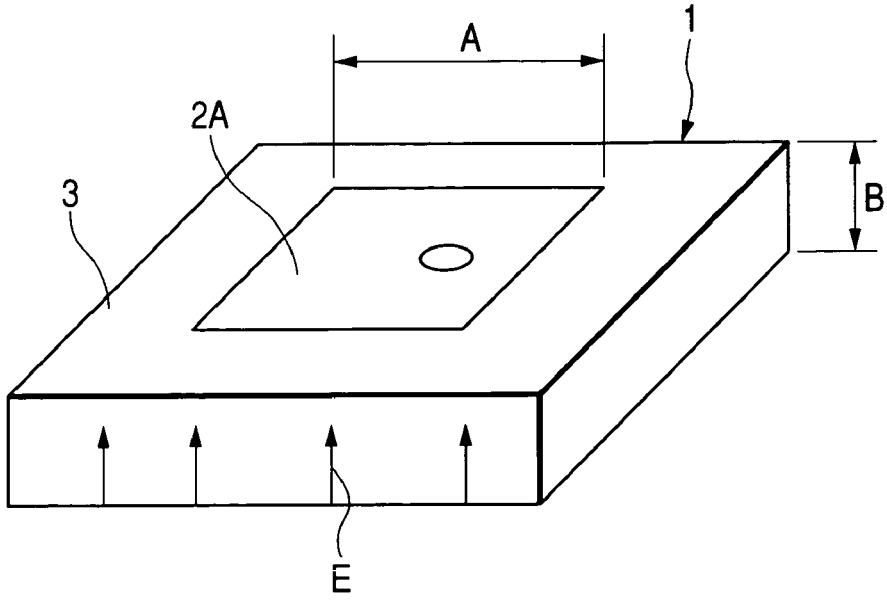
FIGS. 5A and 5B are views illustrating a characteristic of a relationship between a length of a flat antenna and a thickness of a dielectric substrate.
Figure 5B:
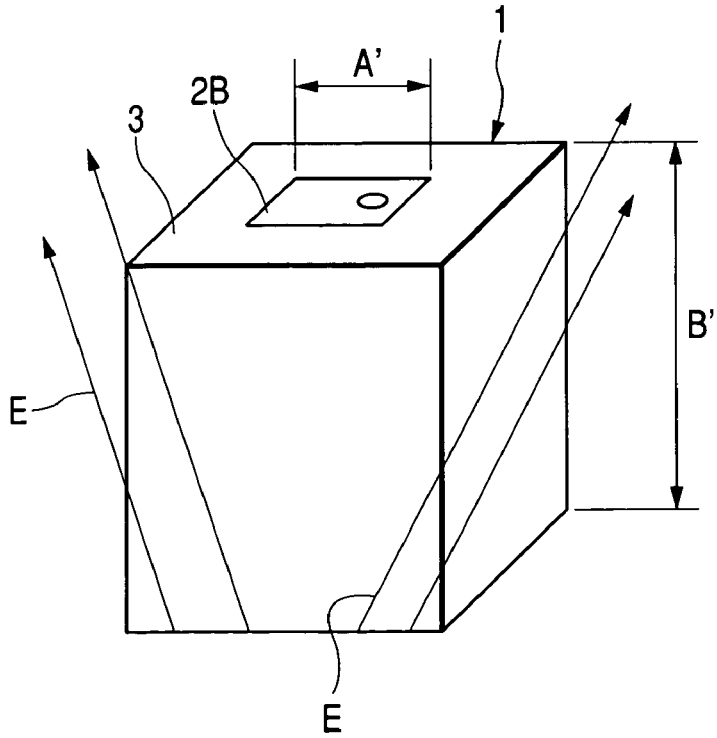

In the case, the antenna lengths L1 through L5 of the first through fifth flat antenna patterns 115*a* through 115*e* are gradually increased sequentially, and the plate thickness of the dielectric substrate 11 is decreased in accordance with the gradual increasing of the antenna lengths L1 through L5; by means of the gradual decreasing of plate thickness, the radiation patterns (directionality patterns) of the antenna patterns in each bands can be controlled to patterns of a desired direction of the kind shown with black arrows in FIG. 4.

With the present invention, by setting thicknesses of a dielectric substrate at flat regions to thicknesses suited to the frequency bands of each antenna patterns provided on those flat regions, it is possible to form a flat antenna that shows good radio characteristics with low radiation losses in the frequency bands and thereby it is possible to form a flat antenna that shows excellent radio characteristics corresponding to different frequency bands.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An antenna comprising:

a dielectric substrate in which a plate thickness decreases from a central region to an annular region; and a plurality of flat antenna patterns provided on the each of regions of the dielectric substrate, wherein the plurality of flat antenna patterns each receives or transmits electric waves having different frequency bands respectively.

2. The antenna according to claim 1, wherein a back side of the dielectric substrate is configured to be flat, the back side opposes to a side where the plurality of antenna patterns are provided, wherein the back side of the dielectric substrate comprises a grounding conductor formed on the back side.

3. The antenna according to claim 2, wherein the dielectric substrate is made of a synthetic resin material.

4. The antenna according to claim 2, wherein said central region is defined by a single closed line, wherein said annular region comprises a plurality of annular regions surrounding the central region and each defined by two concentric closed lines, wherein the plurality of annular regions are configured to have different height.

5. The antenna according to claim 4, wherein a thickness of each of the regions of the dielectric substrate are configured to decrease sequentially from the central region to the annular region that is positioned outermost.

6. The antenna according to claim 4, wherein frequency bands of electric waves that each of the flat antenna patterns receives or transmits are configured to increase sequentially from the frequency bands of the electric wave that a flat antenna pattern disposed on the central region receives or transmits, to the frequency bands of the electric wave that a flat antenna pattern disposed on the annular region that is positioned outermost receives or transmits.

7. The antenna according to claim 2, wherein the flat antenna patterns are disposed on each of the regions in an order of frequency bands of electric waves that each of the flat antenna patterns receives or transmits.

8. The antenna of claim 1, wherein each of said central region and said annular region is rectangular.

9. The antenna of claim 1, wherein a front side of said dielectric substrate, upon which said plurality of flat antenna patterns are provided, is flat and wherein a back side of said dielectric substrate is stepped.

10. An antenna comprising:

a dielectric substrate having a thickness that decreases from a central region to an annular region;

a first antenna pattern on a first side of said dielectric substrate in said central region; and a second antenna pattern on said first side of said dielectric substrate in said annular region.

11. The antenna of claim 10, wherein a second side of said dielectric substrate is flat.

12. The antenna of claim 11, wherein said first side is stepped.

13. The antenna of claim 10, wherein said first side of said dielectric substrate is flat.

14. The antenna of claim 13, wherein a second side of said dielectric substrate is stepped.

15. The antenna of claim 10, wherein said dielectric substrate comprises a synthetic resin.

16. The antenna of claim 10, wherein said annular region comprises a plurality of annular regions and wherein said second antenna pattern comprises a plurality of antenna patterns.

* * * * *